US006701982B1

(12) United States Patent
Ortiz et al.

(10) Patent No.: US 6,701,982 B1
(45) Date of Patent: Mar. 9, 2004

(54) APPARATUS AND METHOD FOR A GASOLINE HOSE ASSEMBLY COVER

(76) Inventors: Alvaro A. Ortiz, 2601 E. McKellips Rd., Apt. 2052, Mesa, AZ (US) 85213; Charles Lewis Letherwood, Jr., 4726 NE. Everett St., Portland, OR (US) 97213

( * ) Notice: Subject to any disclaimer, the term of this patent is extended or adjusted under 35 U.S.C. 154(b) by 0 days.

(21) Appl. No.: 10/166,545

(22) Filed: Jun. 10, 2002

Related U.S. Application Data

(60) Provisional application No. 60/296,828, filed on Jun. 11, 2001.

(51) Int. Cl.[7] ..... B65B 1/04

(52) U.S. Cl. ..... 141/392; 141/97; 141/86; 141/311 A; 141/390; 137/377; 138/110

(58) Field of Search ..... 141/392, 382, 141/206, 207, 208, 209, 210, 97, 93, 86, 311 A, 390; 137/375, 377, 382; 138/110

(56) References Cited

U.S. PATENT DOCUMENTS 1,894,867 A * 1/1933 Hoffman ..... 141/392
2,737,972 A * 3/1956 Callery et al. ..... 137/377
3,116,774 A * 1/1964 Callahan ..... 137/375
5,505,500 A * 4/1996 Webb et al. ..... 137/375

OTHER PUBLICATIONS

Journal of AMA, vol. 168, No. 7; published on Oct. 18, 1958; Maurice Gershman, M.D.; p. 930.*

* cited by examiner

*Primary Examiner*—Gregory L. Huson
*Assistant Examiner*—Khoa Huynh
(74) *Attorney, Agent, or Firm*—George L Williamson

(57) ABSTRACT

The present invention discloses an apparatus and a method for a cover for placement over a gasoline hose assembly of a gasoline delivery system for a gasoline delivery truck. The cover comprises a hole for placement of the hose therein along with fasteners or a clip for attachment of the cover to the hose having weights stitched or formed into the hem of the cover in such a way to hold the edges of the cover down so as to prevent the entrance of rain or debris into the gasoline tank receiving nozzle.

14 Claims, 2 Drawing Sheets

APPARATUS AND METHOD FOR A GASOLINE HOSE ASSEMBLY COVER

This application claims benefit of Provisional Application Serial No. 60/296,828 filed on Jun. 11, 2001.

BACKGROUND OF THE INVENTION

1. Field of the Invention

The present invention generally relates to a gasoline hose assembly and, more particularly, is concerned with an apparatus and method for a cover for a gasoline hose assembly.

2. Description of the Prior Art

Containment assemblies for fill hoses have been described in the prior art. However, none of the prior art devices disclose the unique features of the present.

In the U.S. Pat. No. 5,363,907, dated Nov. 15, 1994, Dunning et al, disclosed a hose assembly suited for delivering viscous material to a dispenser nozzle at a controlled viscosity and temperature. The hose assembly includes a jacketed hose including an outer hose positioned around an inner hose carrying the mastic and defining an annular passage between the inner hose and the outer hose, and a hose cover assembly adapted to be releasably wrapped around a further remote hose carrying the mastic. The cover assembly includes an elongated strip of flexible material including generally parallel opposite longitudinal edges; a plurality of tubes embedded in the strip and running longitudinally through the strip; and coacting interengagable quick release means (such as a zipper) on the opposite longitudinal edges of the strip to enable the strip to be wrapped around the hose and secured in position around the hose by releasable interengagement of the quick release means.

In the U.S. Pat. No. 4,780,063 dated Oct. 25, 1988, Tuckey disclosed an electric in-tank fuel pump for vehicles which is provided with a noise-reduction jacket of relative soft material spaced from the pump housing by internal projections on the jacket which contact the pump housing by internal projections on the jacket which contact the pump housing. An extended skirt on one embodiment serves to collect vapor which rises in the jacket to maintain a low liquid fuel level around the pump. A quick connect-disconnect from the pump to a fuel line with an integral unidirectional valve is provided to maintain fuel line pressure when the pump is not operating. Also, an inlet unidirectional valve is provided to prevent fuel from siphoning out of the pump.

In the U.S. Pat. No. 5,365,973, dated Nov. 22, 1994 Fink, Jr. et al., disclosed a break away hose coupling for use in conjunction with a vapor recovery nozzle and for application within a fuel line, that prevents untimely decoupling, that only decouples upon the exertion of a pre-determined amount of tension, while preventing unnecessary leakage of fuel and vapors, while being fully reconnectable. The coupling includes a pair of fittings, for connecting to the fuel line, a sleeve for housing the fittings, and each fitting incorporating a check valve to provide for closure of the fluid flow passage and closure of the vapor flow passage when decoupling occurs, a fluid chamber providing for flow of fluid and vapor return passage, internal of the fluid flow passage, allowing vapor recovery in a concentric line. The device is pressure compensated to eliminate the effects of line shock.

In U.S. Pat. No. 5,217,052, dated Jun. 8, 1993, Sharp disclosed an assembly intended for use on underground storage tanks provides ready access to fill pipe from ground level. At the same time the assembly serves as a spill containment means for accidental spillage and a secondary containment means for the fill pipe. The assembly of the invention comprises a secondary containment chamber having a sidewall with means for attaching to the storage tank. An anchor ring which is attached to an upper open end of the containment chamber acts as a permanent ground base for the assembly. A bridging surface cover within an anchor ring has a removable lid positioned in its interior portion to gain access to the chamber's interior for a filling operation. The assembly also comprises a fill pipe for delivering liquid to the storage tank. The fill pipe is positioned within the secondary containment chamber with a discharging end extending through the chambers bottom and a receiving end terminating within the chamber but near the bridging surface cover. An open top spill compartment is positioned within the secondary containment chamber and at the receiving end of the fill pipe so as to encompass the fill pipe's receiving end for the purpose of catching any spilled liquid from the filling operation. The spill compartment also prevents any of the spilled liquid and vapors from entering the secondary containment chamber.

In U.S. Pat. No. 4,793,387, dated Dec. 27, 2988, LeBlanc et al., disclosed and overfill and spillage protection device for capturing fuel spilled from a tank touch supply hose or the fill pipe of an underground fuel storage tank takes the form of a tubular reservoir having an axially flexible bellows shaped side wall. Forces induced by freezing or thawing of the ground in which the reservoir is embedded which would apply strain to the coupling between the reservoir and fill pipe are absorbed by the flexing action of the bellows shaped reservoir. A rigid tubular skirt slidably encloses the bellows portion to prevent concrete or dirt from packing into the concave regions of the bellows.

In U.S. Pat. No. 5,566,731, dated Oct. 22, 1996, Holland disclosed a device to capture, contain and collect hydrocarbon fuels such as gasoline and diesel before they can be spilled or leaked from the ventilation valve or fuel intake port of the fuel tank of a vessel and on to the surface of the water during fueling operations a marine fueling facilities. The device is formed as a low-profile box with a floor section and upright wall sections having stratified layers of a textile material and a solidifying polymer enclosed within an outer envelope of textile material. A seamed area at the center of the device with slits in the textile material allows the device to circumscribe the annular conduit of a device passing through the seamed area.

In U.S. Pat. No. 4,930,543, dated Jun. 5, 1990, Zuiches disclosed a flexible body member is constructed so as to be wrapped around a hose at connector portions thereof and has overlapping side portions. The body member has releasable securement on its overlapping areas and also has a widened portion intermediate the ends thereof for accommodating the interfitting coupling members and for holding the device on the coupling members. The releasable securement on the overlapping side areas is by continuous and full length fastening elements such as Velcro. The device also has padding to provide desired cushioning and insulation In U.S. Pat. No. 6,178,990 B1, dated Jan. 30, 2001, Bellenger et al., disclosed a drop chute guard contains spills in conjunction with a loading hose supplying fuel to an in-ground storage tank. The spill guard includes a flexible barrier sized to surround the sump and sealing ring having an outside diameter substantially corresponding to a diameter of the sump. An opening is disposed in the vicinity of the tank inlet and extends through the barrier and the sealing ring for receiving the drop chute.

While these containment devices may be suitable for the purposes for which they were designed, they would not be as suitable for the purposes of the present invention, as hereinafter described.

SUMMARY OF THE INVENTION

The present invention discloses an apparatus and a method for a cover for placement over a gasoline hose assembly of a gasoline delivery system for a gasoline delivery truck. The cover comprises a hole for placement of the hose therein along with fasteners for attachment of the cover to the hose having weights stitched into the hem of the cover in such a way to hold the edges of the cover down so as to prevent the entrance of rain or debris into the gasoline tank receiving nozzle.

An object of the present invention is to prevent the entrance of debris into the fill aperture of the gasoline tank. A further object of the present invention is to prevent the entrance of water or rain into the gasoline tank aperture. Further, an object of the present invention is to provide an inexpensive way to maintain a neat area around the gasoline tank fill aperture area.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
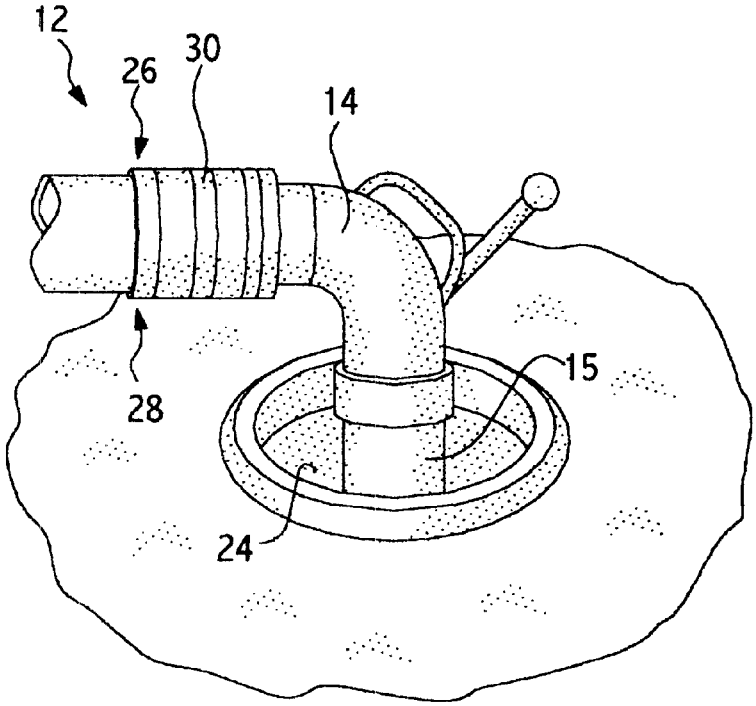
FIG. 1 is a photograph of a conventional hose assembly in use.

With regard to reference numerals used, the following numbering is used throughout the drawings.

10 present invention
12 fill hose
14 head of fill hose assembly
15 fuel filler nozzle
16 hole
17 fasteners
18 clip
20 hook and loop material straps
22 weighted edge
24 gasoline tank aperture
26 upper portion
28 lower portion
30 head-hose connection
32 reinforced edges

DESCRIPTION OF THE PREFERRED EMBODIMENT(S)

In order that the invention may be more fully understood, it will now be described, by way of example, with reference to the accompanying drawings in which FIGS. 1 through 4 illustrate the present invention wherein a cover for a gasoline hose assembly is disclosed.

Turning to FIG. 1, shown therein is a photograph of a conventional gasoline hose assembly 12 having a head 14 thereon with the fuel filler nozzle 15 extending downwardly into the underground gasoline tank inlet aperture 24 without the present invention being attached thereto. It can be seen that in the standard configuration the hose 12, head 14 and filler nozzle 15 form an "L" shaped assembly having about a 90 degree elbow therein wherein the hose is in substantially the horizontal plane so that the head-hose connection area 30 has an upper portion 26 and a lower portion 28.

Figure 2:
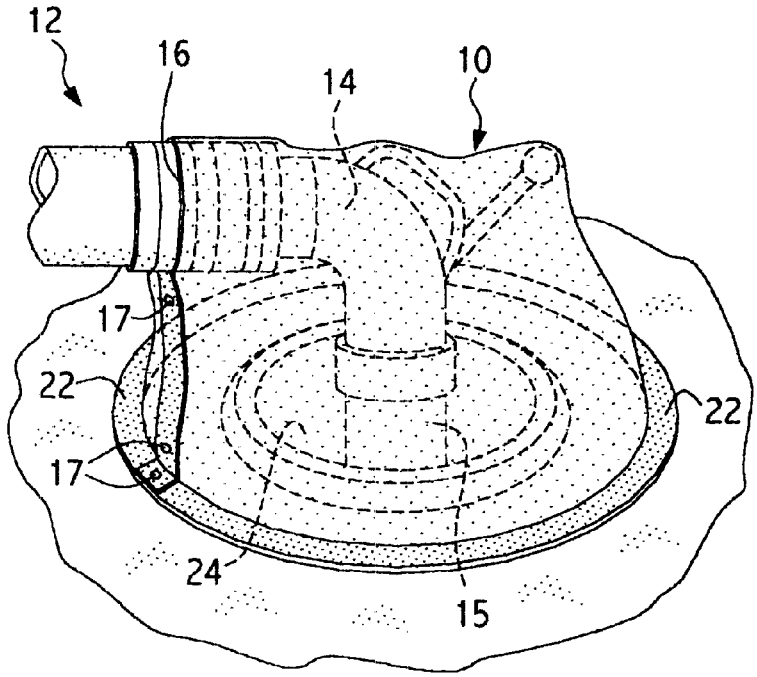
FIG. 2 is a photograph showing the present invention in use.

Turning to FIG. 2, shown therein is the present invention 10 in operative connection having a hole therein 16 through which the fill hose 12 and fill head 14 pass. A plurality of fasteners 17 are shown for attaching the hole 16 of the present invention 10 over and about the fill hose 12 by having the fasteners 17 connect to each other at the lower portion of the head-hose connection area to form a tent-like cover. The fasteners 17 may be heavy duty snaps, hook and loop material or the like. Also shown are a weighted edge 22 stitched or otherwise formed into the lower hemline of the present invention 10 whereby the present invention is maintained in place so as to provide a secure cover about the gasoline tank receiving aperture 24 in which the fill hose head 14 is placed.

Figure 3:
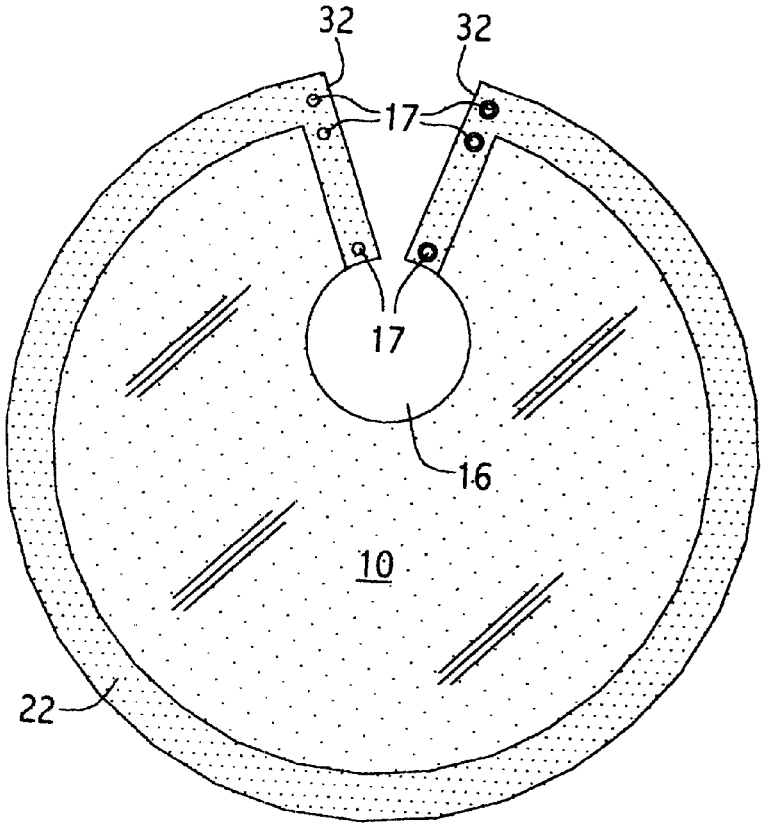
FIG. 3 is a plan view of the present invention in a flattened disposition.

Turning to FIG. 3, shown therein is the flexible, clear present invention 10 in a flattened disposition showing the off-center hole 16, fasteners 17, the weighted edges 22, and a pair of nylon reinforced connecting radially disposed edges 32 which are formed by a split or part in the cover which run in generally a straight line from the edge of hole 16 to the outer circumference of the present invention 10. The present invention 10 may also be waterproof and fuelproof.

Figure 4:
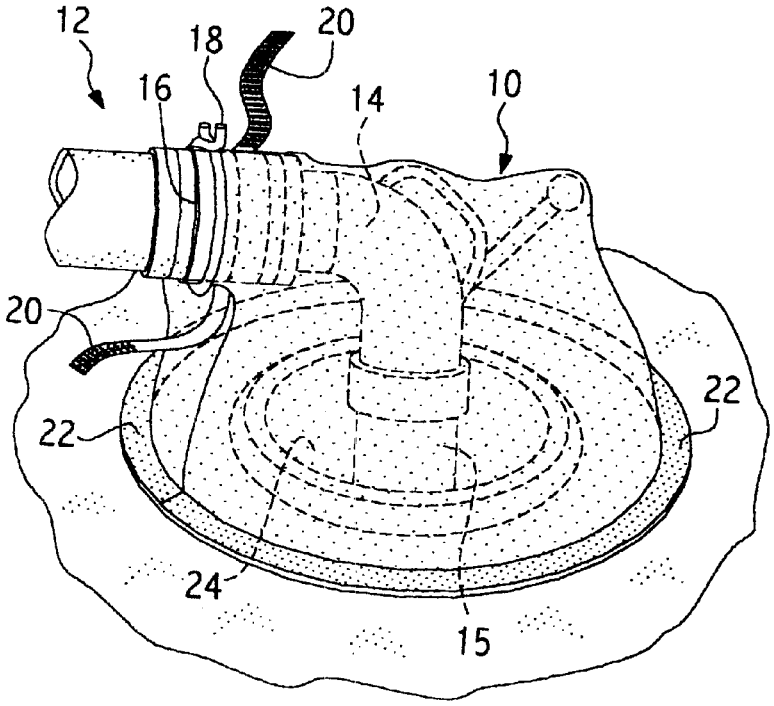
FIG. 4 is a perspective view of the present invention in use.

Turning to FIG. 4, shown therein is an alternate embodiment of the present invention 10 placed about a gasoline fill line 12 with head 14 thereon. The present invention 10 is shown having a hole therein 16 through which the fill hose and fill head pass. An aluminum clip 18 is shown for attaching the hole of the present invention about the fill hose 12. Also shown are hook and loop material straps 20 for placement about the fill hose so as to attach the present invention 10 thereto. Also shown are weights 22 stitched or formed into the lower hemline of the present invention 10 whereby the present invention is maintained in place so as to provide a secure cover about the gasoline tank receiving aperture 24 in which the fill hose head 14 is placed.

The method of the present invention for shrouding a fuel nozzle assembly while filling an underground fuel storage tank can be described generally as follows: 1) providing a flexible shroud for placement about the fuel nozzle assembly, wherein the shroud is substantially circular shaped when flattened having a hole therein and a split therein; 2) placing the hole off-center of the shroud, so that the shroud is parted into a first part and a second part by a split running substantially straight from an edge of the hole toward an outer edge of the shroud thereby forming a first radial edge and a second radial edge of the shroud; c) placing a portion of the fuel nozzle assembly in the hole to permit the shroud to be placed about the fuel nozzle assembly; d) fastening the first radial edge and second radial edge of the parted shroud together to attach the shroud about the fuel nozzle assembly in order to secure the shroud to the fuel nozzle assembly; and, e) weighting the edge of the outer circumference of the shroud to permit the outer edges of the shroud to be secured about the fuel nozzle assembly.

What is claimed to be new and desired to be protected by Letters Patent is set forth in the appended claims.

I claim:

1. A shroud for placement about a fuel nozzle assembly while filling an underground fuel storage tank, the fuel nozzle assembly for placement in the inlet aperture of the underground storage tank, comprising:

a) a flexible shroud for placement about the fuel nozzle assembly, wherein the fuel nozzle assembly is disposed on an end of a fuel hose, said fuel hose being disposed in substantially the horizontal plane, wherein said shroud is substantially circular shaped when flattened, said shroud having a hole therein, said shroud having a split therein;

b) wherein said hole is disposed off-center of said shroud, said shroud being parted into a first part and a second part by said split running substantially straight from an edge of said hole toward an outer edge of said shroud thereby forming a first radial edge and a second radial edge of the shroud;

c) wherein said hole receives a portion of said horizontal fuel hose therein to permit the shroud to be placed about the fuel hose and the fuel nozzle assembly;

d) a plurality of mating fasteners disposed on said first radial edge and second radial edges of said shroud to permit the shroud to be secured about the fuel nozzle assembly; and, e) a weighted edge disposed about the outer circumference of said shroud to permit the outer edge of the shroud to be secured about the inlet aperture.

2. The shroud of claim 1, wherein said hole is complimentarily sized to receive a fuel assembly hose.

3. The shroud of claim 2, wherein said shroud is made of waterproof material.

4. The shroud of claim 3, wherein said shroud is made of fuelproof material.

5. The shroud of claim 4, wherein said shroud is made of clear material.

6. The shroud of claim 5, wherein said first radial edge and said second radial edge of said shroud are reinforced so that they are made stronger.

7. The shroud of claim 6, wherein said fasteners comprise mating snaps.

8. A method for shrouding a fuel nozzle assembly while filling an underground fuel storage tank, the fuel nozzle assembly for placement in the inlet aperture of the underground storage tank, comprising the steps of:

a) providing a flexible shroud for placement about the fuel nozzle assembly, which nozzle assembly is disposed on an end of a horizontally disposed fuel hose, wherein the shroud is substantially circular shaped when flattened having a hole therein and a split therein;

b) placing the hole off-center of the shroud, so that the shroud is parted into a first part and a second part by a split running substantially straight from an edge of the hole toward an outer edge of the shroud thereby forming a first radial edge and a second radial edge of the shroud;

c) placing a portion of the horizontal fuel hose in the hole to permit the shroud to be placed about the fuel hose and the fuel nozzle assembly;

d) fastening the first radial edge and second radial edge of the parted shroud together to attach the shroud about the fuel nozzle assembly in order to secure the shroud to the fuel nozzle assembly; and, e) weighting the edge of the outer circumference of the shroud to permit the outer edges of the shroud to be secured about the inlet aperture.

9. The method of claim 8 further comprising the step of sizing the hole to receive a fuel assembly hose.

10. The method of claim 9 further comprising the step of making the shroud of waterproof material.

11. The method of claim 10 further comprising the step of making the shroud of fuelproof material.

12. The method of claim 11 further comprising the step of making the shroud of clear material.

13. The method of claim 12 further comprising the step of reinforcing the first radial edge and the second radial edge of the shroud so that they are stronger.

14. The apparatus of claim 13 further comprising the step of making the fasteners of mating snaps.

* * * * *